US006780092B2

(12) United States Patent
Yi

(10) Patent No.: US 6,780,092 B2
(45) Date of Patent: Aug. 24, 2004

(54) POLISHING TOOL USED FOR CMP

(75) Inventor: Champion Yi, Hsinchu (TW)

(73) Assignee: Promos Technologies, Inc., Hsinchu (TW)

( * ) Notice: Subject to any disclaimer, the term of this patent is extended or adjusted under 35 U.S.C. 154(b) by 0 days.

(21) Appl. No.: 10/126,183

(22) Filed: Apr. 19, 2002

(65) Prior Publication Data

US 2003/0068965 A1 Apr. 10, 2003

(30) Foreign Application Priority Data

Oct. 4, 2001 (TW) ..... 90124547 A

(51) Int. Cl.[7] ..... B24B 29/00
(52) U.S. Cl. ..... 451/289; 451/388
(58) Field of Search ..... 451/289, 288, 451/287, 286, 285, 388, 398, 259, 283, 60, 41

(56) References Cited

U.S. PATENT DOCUMENTS 6,106,369 A * 8/2000 Konishi et al. ..... 451/41
6,152,805 A * 11/2000 Takahashi ..... 451/36
6,227,956 B1 5/2001 Halley
6,299,506 B2 * 10/2001 Nishimura et al. ..... 451/8
6,340,326 B1 * 1/2002 Kistler et al. ..... 451/286
6,390,903 B1 * 5/2002 Takahashi et al. ..... 451/286

* cited by examiner

*Primary Examiner*—Dung Van Nguyen
(74) *Attorney, Agent, or Firm*—Volpe and Koenig, P.C.

(57) ABSTRACT

A polishing tool used for a CMP process is disclosed. The polishing tool includes a polishing platen for holding a wafer faced-up thereon and carrying the wafer to move to and fro between a first position and a second position, a polishing pad for polishing the wafer, and a holder for holding the polishing pad to self-rotate and carrying the polishing pad to move across the wafer surface and further driving the polishing pad to polish the wafer.

17 Claims, 3 Drawing Sheets

POLISHING TOOL USED FOR CMP

FIELD OF THE INVENTION

This invention relates to a polishing tool, and more particularly to a polishing tool used for a Chemical-Mechanical Planarization (CMP) process.

BACKGROUND OF THE INVENTION

With the miniaturization trend of semiconductor elements, the control in the manufacturing process of semiconductors is more and more important. As for the planarization process, the traditional Spin-on Glass and Etch Back are hard to meet the current requirement of planarization, and Chemical-Mechanical Planarization (CMP) are being employed with increasing frequency.

The application of fixed abrasive pads is so far the most advanced technology in CMP to achieve global planarization. The fixed abrasive pad is patented by the 3M company for their micro-replication technology. By mixing the $CeO_2$ abrasive particles with resin so as to form protrusions on the surface, the fixed abrasive pad is capable of removing the material on the "up" area of the wafer topography without touching the "down" area of the wafer topography (i.e. IC). In addition, KOH is usually added on the pad for preventing the wafer surface from being adhered with silicon oxide and $CeO_2$ residues to reduce the formation of scratches and increase the polishing rate. Since the liquid slurry is not used for this type of pad, it is often referred as "slurry-free" CMP.

The fixed abrasive pad is usually combined with non-rotary polishing tool (such as stationary magazine web and high speed linear belt) to polish the wafer. The traditional rotary polishing tool is not suitable for the fixed abrasive pad due to the following disadvantages:

1. The lifetime of the pad is short due to the repetitive wearing of the pad in the same area and thereby increasing the production cost.
2. The released $CeO_2$ powder and fragments remain on the pad and tend to agglomerate, and further cause scratches on the wafer surface.
3. The wafer edge uniformity is difficult to control, since the advanced carriers are all designed with edge ring pressed on the pad, which is still not yet proven for the fixed abrasive pad.

The polishing tool with a wafer sitting on the vacuum chuck and a small polishing pad above moving across the wafer surface is already available (as disclosed in U.S. Pat. No. 6,227,956), but all are designed for conventional consumables. This type of polishing tool used for the conventional consumables has the following disadvantages:

1. The wafer still rotate at high speed which causes large amount of slurry consumption due to the strong centrifugal force.
2. The friction force between the wafer and the pad is large so that the polishing head is hard to move.
3. The uniformity control is difficult due to the interaction between process parameters and slurry flow patterns under the pad.

Therefore, the present invention provides a polishing tool to overcome the disadvantages of the prior art described above.

SUMMARY OF THE INVENTION

It is an object of the present invention to provide a polishing tool used for a CMP process.

In accordance with an aspect of the present invention, the polishing tool includes a polishing platen for holding a wafer faced-up thereon and carrying the wafer to move to and fro between a first position and a second position, a polishing pad for polishing the wafer, and a holder for holding the polishing pad to self-rotate and carrying the polishing pad to move across the wafer surface and further driving the polishing pad to polish the wafer.

Preferably, the size of the pad is smaller than that of the wafer.

Preferably, the diameter of the polishing platen is ranged from 12 to 20 inches.

Preferably, the distance between the first position and the second position is at least one diameter of the wafer.

Preferably, the distance between the first position and the second position is 2 times the diameter of the wafer Preferably, the moving rate of the polishing platen is ranged from 1 to 1000 mm/sec.

Preferably, the moving rate of the polishing platen is 1 m/min.

Preferably, the movement of the polishing platen with the wafer between the first position and the second position is linear.

Preferably, the polishing platen is a vacuum chuck.

Preferably, the vacuum chuck has plural air-extracting holes, which are vacuumed after the interior air thereof is extracted, for allowing the wafer to adhere tightly to the vacuum chuck.

Preferably, the plural air-extracting holes are arranged as a plurality of rings with different diameters and are air-extracted adjustably for corresponding to the size of the wafer.

Preferably, the polishing pad is a fixed abrasive pad.

Preferably, the diameter of the polishing pad is ranged from 1 to 12 inches.

Preferably, the polishing tool employs KOH solution for preventing the wafer surface from being adhered with powder and fragments generated in the polishing process.

Preferably, the KOH solution is injected into the polishing tool through the holder.

Preferably, the KOH solution is supplied directly on the wafer surface.

Preferably, the self-rotate speed of the pad is between 1~1000 RPM.

Preferably, the holder is interchangeable for handling the polishing pad with different size.

Preferably, the polishing tool further includes a movable arm connected with the holder for carrying the polishing pad to move across the wafer surface.

Preferably, the moving path of the polishing pad to move across the wafer surface is a substantial curve The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
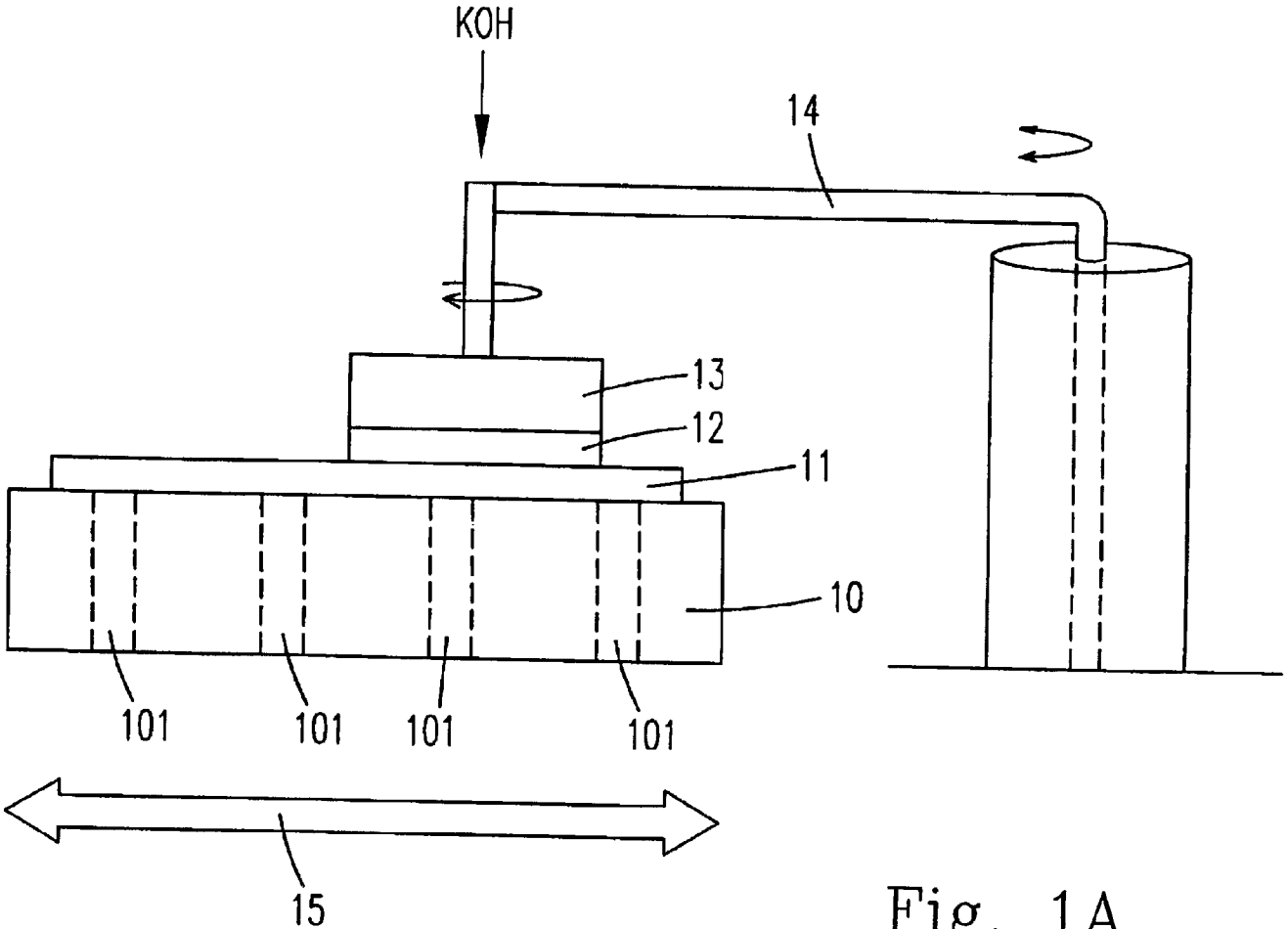
FIG. 1A is a schematical view showing the structure of the polishing tool according to a preferred embodiment of the present invention.

Please refer to FIG. 1A showing the structure of the polishing tool according to a preferred embodiment of the present invention. The polishing tool used for a CMP process includes a polishing platen of a vacuum chuck 10, a polishing pad 12 and a holder 13. The vacuum chuck 10 is used for holding a wafer 11 faced-up thereon and carrying the wafer 11 to move to and fro between a first position and a second position as a linear movement (as shown as the drawing numeral 15 in FIG. 1A). The vacuum chuck 10 has plural air-extracting holes 101. After the interior air is extracted, the air-extracting holes 101 are vacuumed for allowing the wafer 11 to adhere tightly to the vacuum chuck 10. The diameter of the vacuum chuck 10 is ranged from 12 to 20 inches. The moving rate of the vacuum chuck 10 is ranged from 1 to 1000 mm/sec, and is preferably 1 m/min. In addition, the distance between the first position and the second position is at least one diameter of the wafer 11, and is preferably 2 times the diameter of the wafer 11.

Figure 1B:
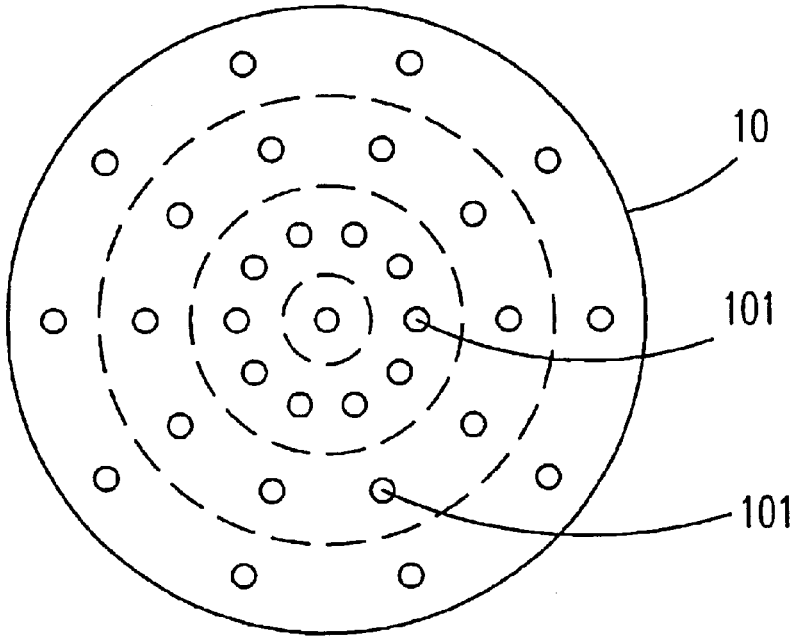
FIG. 1B is a top plane view showing the structure of the vacuum chuck according to a preferred embodiment of the present invention.

Please refer to FIG. 1B. The plural air-extracting holes 101 of the vacuum chuck 10 are arranged as a plurality of rings with different diameters. The vacuum chuck 10 can be used for the wafers with 12 to 20 inches in diameter by adjusting the air-extracting holes 101 being air-extracted when the wafer size varies. For example, when the wafer is 12 inches in diameter, only the inner rings of the air-extracting holes 101 are air-extracted, and when the wafer becomes larger, the outer rings of the air-extracting holes 101 corresponding to the wafer size are air-extracted gradually as well as the inner rings.

Please refer to FIG. 1A. The polishing pad 12 can polish the protruding oxide layer on the wafer 11 surface. The size of the pad is smaller than that of the wafer 11. The polishing pad 12 is preferably a fixed abrasive pad, and the diameter of the polishing pad 12 is ranged from 1 to 12 inches.

Figure 2:
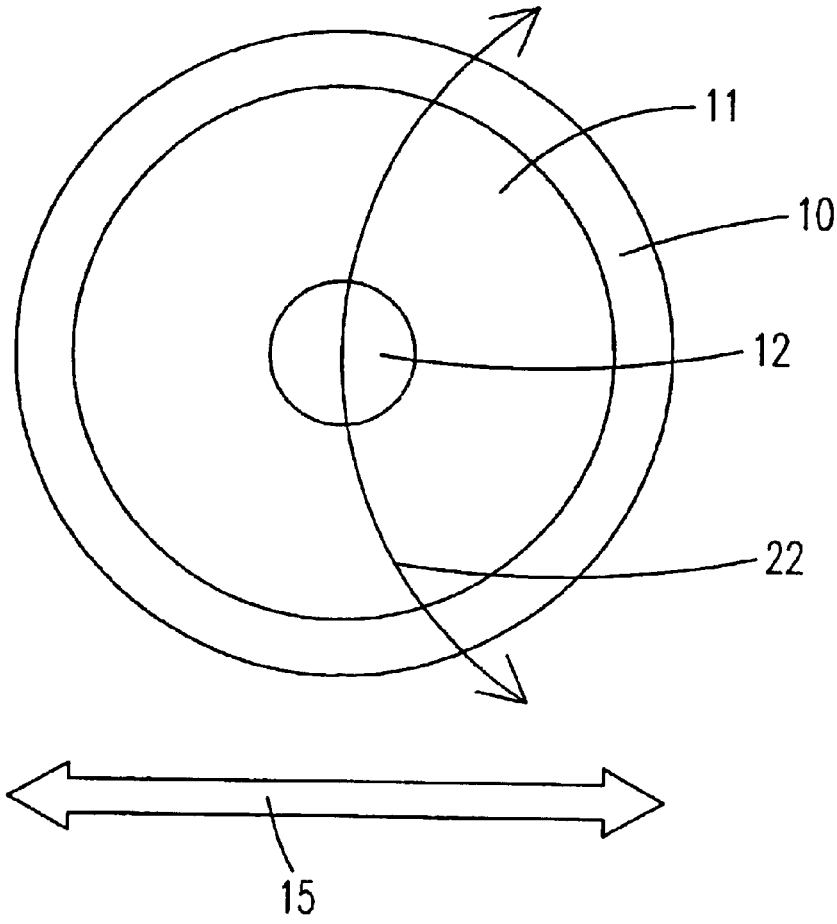
FIG. 2 is a vertical view showing the moving path of the polishing pad to move across the wafer surface according to a preferred embodiment of the present invention.

Please refer to FIGS. 1A and 2. The polishing tool further includes a movable arm 14 connected with the holder 13 for carrying the polishing pad 12 to self-rotate and move across the wafer 11 surface (the moving path is a substantial curve as shown as the drawing numeral 22 in FIG. 2), and further driving the polishing pad 12 to polish the wafer 11 surface. The self-rotate speed of the pad is between 1~1000 RPM. In addition, the holder 13 is interchangeable for handling the polishing pad 12 with the diameter ranged from 1 to 12 inches.

The polishing tool further employs the KOH solution for preventing the wafer 11 surface from being adhered with powder and fragments generated in the polishing process. The KOH solution is injected into the polishing tool through the holder 13 or supplied directly on the wafer 11 surface.

In conclusion, the present invention can overcome the disadvantages of the prior art, such as large amount of slurry consumption and difficult movement of the polishing head due to the large friction force between the wafer and the polishing pad, and has the following advantages:

1. The hardware design of the present invention can be used for both rotary and non-rotary polishing tools.
2. The sizes of the polishing pad and the polishing platen are adjustable for corresponding to different wafer sizes.
3. The wafer is stationary during polishing, and therefore the wafer breakage is prevented.
4. The friction force between the wafer and the polishing pad is small (due to small contact area), which reduces the possibility of wafer damage.
5. There is no need for pad conditioning during pad life (less than 100 wafers), and it is easy to stop working of the polishing pad.
6. The polishing pad can work effectively with the small pad surface, and when the pad life is over, it can be changed quickly to reduce the down time.

Therefore, the present invention exhibits the industrial application and the high commercial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A polishing tool used for a Chemical-Mechanical Planarization (CMP) process, comprising:

a polishing platen for holding a wafer faced-up thereon and carrying said wafer to move to and fro between a first position and a second position, wherein said polishing platen is a vacuum chuck having plural air-extracting holes that are vacuumed after the interior air thereof is extracted for allowing said wafer to adhere tightly to said vacuum chuck and wherein the holes are arranged as a plurality of rings with different diameters and air-extracted adjustably for corresponding to the size of said wafer;

a polishing pad for polishing said wafer; and a holder for holding said polishing pad to self-rotate and carrying said polishing pad to move across said wafer surface and further driving said polishing pad to polish said wafer.

2. The polishing tool according to claim 1 wherein the size of said pad is smaller than that of said wafer.

3. The polishing tool according to claim 1 wherein the diameter of said polishing platen is ranged from 12 to 20 inches.

4. The polishing tool according to claim 1 wherein the distance between said first position and said second position is at least one diameter of said wafer.

5. The polishing tool according to claim 1 wherein the distance between said first position and said second position is 2 times the diameter of said wafer.

6. The polishing tool according to claim 1 wherein the moving rate of said polishing platen is ranged from 1 to 1000 mm/sec.

7. The polishing tool according to claim 1 wherein the moving rate of said polishing platen is 1 m/min.

8. The polishing tool according to claim 1 wherein the movement of said polishing platen with said wafer between said first position and said second position is linear.

9. The polishing tool according to claim 1 wherein said polishing pad is a fixed abrasive pad.

10. The polishing tool according to claim 1 wherein the diameter of said polishing pad is ranged from 1 to 12 inches.

11. The polishing tool according to claim 1 wherein said polishing tool employs KOH solution for preventing said wafer surface from being adhered with powder and fragments generated in said polishing process.

12. The polishing tool according to claim 11 wherein said KOH solution is injected into said polishing tool through said holder.

13. The polishing tool according to claim 11 wherein said KOH solution is supplied directly on said wafer surface.

14. The polishing tool according to claim 1 wherein the self-rotate speed of said pad is between 1~1000 RPM.

15. The polishing tool according to claim 1 wherein said holder is interchangeable for handling said polishing pad with different size.

16. The polishing tool according to claim 1 further comprising a movable arm connected with said holder for carrying said polishing pad to move across said wafer surface.

17. The polishing tool according to claim 1 wherein the moving path of said polishing pad to move across said wafer surface is a substantial curve.

* * * * *